US011933054B2

(12) United States Patent
Garbelotto

(10) Patent No.: US 11,933,054 B2
(45) Date of Patent: Mar. 19, 2024

(54) JOINT FOR STRIP FLOORS

(71) Applicant: PARCHETTIFICIO GARBELOTTO S.R.L., Cappella Maggiore (IT)

(72) Inventor: Antonio Garbelotto, Cappella Maggiore (IT)

(73) Assignee: PARCHETTIFICIO GARBELOTTO S.R.L., Cappella Maggiore (IT)

( * ) Notice: Subject to any disclaimer, the term of this patent is extended or adjusted under 35 U.S.C. 154(b) by 91 days.

(21) Appl. No.: 17/438,568

(22) PCT Filed: Mar. 11, 2020

(86) PCT No.: PCT/IB2020/052129

§ 371 (c)(1),
(2) Date: Sep. 13, 2021

(87) PCT Pub. No.: WO2020/183382

PCT Pub. Date: Sep. 17, 2020

(65) Prior Publication Data

US 2022/0162861 A1 May 26, 2022

(30) Foreign Application Priority Data

Mar. 13, 2019 (IT) ..... 102019000003627

(51) Int. Cl.
*E04F 15/02* (2006.01)

(52) U.S. Cl.
CPC ..... *E04F 15/02038* (2013.01); *E04F 2201/0146* (2013.01); *E04F 2201/042* (2013.01); *E04F 2201/0517* (2013.01)

(58) Field of Classification Search
CPC ..... E04F 15/02044; E04F 2201/0146; E04F 2201/042; E04F 2201/0517; E04F 15/02038
See application file for complete search history.

(56) References Cited

U.S. PATENT DOCUMENTS 6,205,639 B1 * 3/2001 Pervan ..... B23P 11/00 52/592.1
6,339,908 B1 * 1/2002 Chuang ..... E04F 15/04 52/177

(Continued)

FOREIGN PATENT DOCUMENTS

CN 1335444 A 2/2002
CN 102277950 A 12/2011

(Continued)

OTHER PUBLICATIONS

International Search Report dated Apr. 22, 2020 re: Application No. PCT/IB2020/052129, pp. 1-3, citing: JP H07 229276 A and WO 2018/002859 A1.

(Continued)

*Primary Examiner* — Gisele D Ford
(74) *Attorney, Agent, or Firm* — CANTOR COLBURN LLP

(57) ABSTRACT

A joint for floors that are provided by way of a series of strips, constituted by a single linear bar which is constituted by a central planar body from which a first tab and a second tab, which are elastically deformable, protrude laterally.
The first tab and the second tab are selectively associable at adapted seats provided in a lower region and longitudinally with respect to the strips and adjacent to the longitudinal perimetric edges thereof.
Each one of the first tab and the second tab has a first portion, substantially arc-shaped, meant for blending with the planar body, which protrudes toward the outside of the planar body, a second portion, contiguous and blended with the respective first portion, protruding and directed toward the inside of the planar body, and a third portion, contiguous and blended with the second portion, which protrudes toward the outside of the planar body.

12 Claims, 5 Drawing Sheets

(56) References Cited

U.S. PATENT DOCUMENTS

| | | | | |
|---|---|---|---|---|
| 6,446,405 | B1 * | 9/2002 | Pervan | E04F 15/102 52/480 |
| 9,416,546 | B2 * | 8/2016 | Claudin | E04B 1/003 |
| 2007/0289249 | A1 * | 12/2007 | Martel | E04F 15/02 52/715 |
| 2014/0305064 | A1 | 10/2014 | Baker et al. | |
| 2016/0060880 | A1 * | 3/2016 | Stover | E04F 15/02044 52/582.2 |
| 2016/0237695 | A1 * | 8/2016 | Pervan | E04F 15/02038 |
| 2018/0355618 | A1 * | 12/2018 | Bevernage | E04F 15/02005 |
| 2019/0145108 | A1 * | 5/2019 | Hannig | E04F 15/02038 52/582.2 |
| 2019/0203480 | A1 * | 7/2019 | Garbelotto | E04F 15/02038 |
| 2019/0211856 | A1 * | 7/2019 | Getsiv | F16B 5/0028 |

FOREIGN PATENT DOCUMENTS

| | | | |
|---|---|---|---|
| CN | 203961211 | U | 11/2014 |
| CN | 109415907 | A | 3/2019 |
| JP | H07229276 | A | 8/1995 |
| WO | 0127410 | A1 | 4/2001 |
| WO | 2012159162 | A1 | 11/2012 |
| WO | 2018002859 | A1 | 1/2018 |

OTHER PUBLICATIONS

Written Opinion dated Apr. 22, 2020 re: Application No. PCT/IB2020/052129, pp. 1-8, citing: JP H07 229276 A and WO 2018/002859 A1.

IT Search Report dated Aug. 19, 2019 re: Application No. 201900003627, pp. 1-9, citing: JP H07 229276 A and WO 2018/002859 A1.

Chinese Office Action for Chinese Application No. 202080018575, dated Apr. 28, 2023, 10 pages.

* cited by examiner

JOINT FOR STRIP FLOORS

TECHNICAL FIELD

The present application relates to a joint for strip floors.

BACKGROUND

Nowadays it is known to provide flooring surfaces using strips or slats of wood which have on their sides adapted tabs and complementarily shaped seats in order to enable a stable connection between them, when they are arranged mutually adjacent.

However, the provision of such floors has some drawbacks, which include the fact that, because adhesives are used to stably connect the strips, the floor thus obtained cannot be inspected and, in the event of an intervention to replace one or more damaged panels, one is forced to remove them with the impossibility of reconnecting them as they were originally, unless the entire floor is removed.

Furthermore the use of adhesives determines a deterioration of the healthfulness of the environment where the floor is laid and furthermore, once laid, it takes some time before it can be used, since one has to wait for the adhesive to dry.

JPH07229276A is known, which describes a connector for floors that are constituted by strips, which is constituted by a planar central part from the ends of which protrude two tabs which are substantially S-shaped and can be coupled to the grooves that are provided on the strips; such grooves have a rectangular cross-section, the side surface of which, on which the tabs of the connector rest, is perpendicular to the planar central part of the connector; the tabs, once the connector is installed, therefore have a single point of contact with the side surface of the grooves of the strips.

In the absence of different indications and in view of the known art of the sector, the length of the connector is limited with respect to the length of the strip to which it is to be coupled.

In order to assist connection and laying and in order to create a force that pushes the strips downward, it is necessary to interconnect the side surfaces of the strips to each other by way of tapping: in the contact side between two strips there is a convex protuberance adapted to be connected by interlocking with a concave indentation.

One drawback that is found in the use of tapping is that the interconnection between the convex protuberance and the concave indentation does not make it possible, after laying, to remove or replace the strips individually, making it necessary to disassemble the entire floor for the removal or the substitution of one of them.

A further drawback consists in that tapping, for the type of connection that it makes it possible to obtain, creates a great deal of friction between the surfaces that come into mutual contact, effectively making it necessary to remove the entire floor in order to replace or remove a single strip.

This same applicant has filed an Italian patent application for industrial disclosure, no. 102016000067817, which discloses a joint for floors which is constituted by a linear bar, made of metallic material, from which a plurality of separate and adjacent pairs of elastically deformable tabs protrude, which are separated from each other by a notch that in addition partially affects a central planar body which constitutes part of the linear bar.

Each pair of tabs can be selectively associated at adapted seats which are provided underneath and longitudinally with respect to the strips.

Although such solution makes it possible to provide strip floors that can be laid rapidly and without the use of adhesives, some drawbacks have been encountered, such as the fact that the cost of the bar is high, necessitating machining work on it in order to obtain, by making notches, the various pairs of tabs.

Also, the number of bars necessary for laying is proportional to the number of strips to be laid and therefore the individual high cost of each single bar has repercussions on the total number of bars necessary for the entire supply of strips.

Making the bars out of metallic material furthermore increases the overall weight of the product to be stored and shipped for each supply, thereby further increasing costs.

Furthermore, the presence, along the same edge of the planar central body, of separate and adjacent tabs can result in the accidental bending of one or more of them during transport or handling or during laying, with the consequent impossibility of executing the coupling with the seats in the strips.

SUMMARY

Finally, the need to obtain the various pairs of separate and mutually adjacent tabs, while making sure they retain a good level of elastic deformation, requires the production of a joint with sufficiently large dimensions which are such that the joint cannot be applied in renovations in which the intended thickness of the floor is small.

The aim of the present disclosure is therefore to solve the above mentioned technical problems, eliminating the drawbacks in the cited known art, by providing a joint for strip floors that, in addition to making it possible to provide strip floors that can be laid rapidly and without the use of adhesives, also makes it possible to offer low costs of production, storage and transport.

Within this aim, the disclosure provides a joint that can be used even in cases where the intended thickness of the floor is small.

A joint is provided that makes it possible to achieve an optimal coupling with the seats present in the strips even if the tabs should be accidentally and temporarily bent.

The disclosure further obtains a joint that makes it possible even for individual strips to be replaced rapidly and easily.

The disclosure also provides a joint that makes it possible to fix firmly two strips, ensuring the stability of its position once installed.

A joint is provided that makes it possible to reduce the noise caused by a floating or raised floor.

This aim and these and other advantages which will become better apparent hereinafter are achieved by providing a joint for floors that are constituted by a series of strips, which is constituted by a single linear bar which is constituted by a central planar body from which a first tab and a second tab, which are elastically deformable and selectively associable at adapted seats provided in a lower region and longitudinally with respect to said strips and adjacent to the longitudinal perimetric edges thereof, protrude laterally, said first tab and said second tab each being substantially S-shaped with the free end directed toward the outside of said planar body, which is characterized in that said linear bar is made of plastic material, said first tab and said second tab protrude laterally from said planar body in the same direction and seamlessly along said planar body and have a first portion, substantially arc-shaped and meant for blending with said planar body, which protrudes toward the outside of said planar body, a second portion, contiguous and blended with the respective said first portion, which protrudes and is directed toward the inside of said planar body, and a third portion, contiguous and blended with said second portion, which protrudes toward the outside of said planar body, said seats having a shape that is substantially complementary at least to the shape of said first portions and at least to the shape of the initial part of said second portions.

BRIEF DESCRIPTION OF DRAWINGS

Further characteristics and advantages of the disclosure will become better apparent from the detailed description of a particular but not exclusive embodiment thereof, illustrated by way of non-limiting example in the accompanying drawings, wherein.

DETAILED DESCRIPTION OF DRAWINGS

Figure 1:
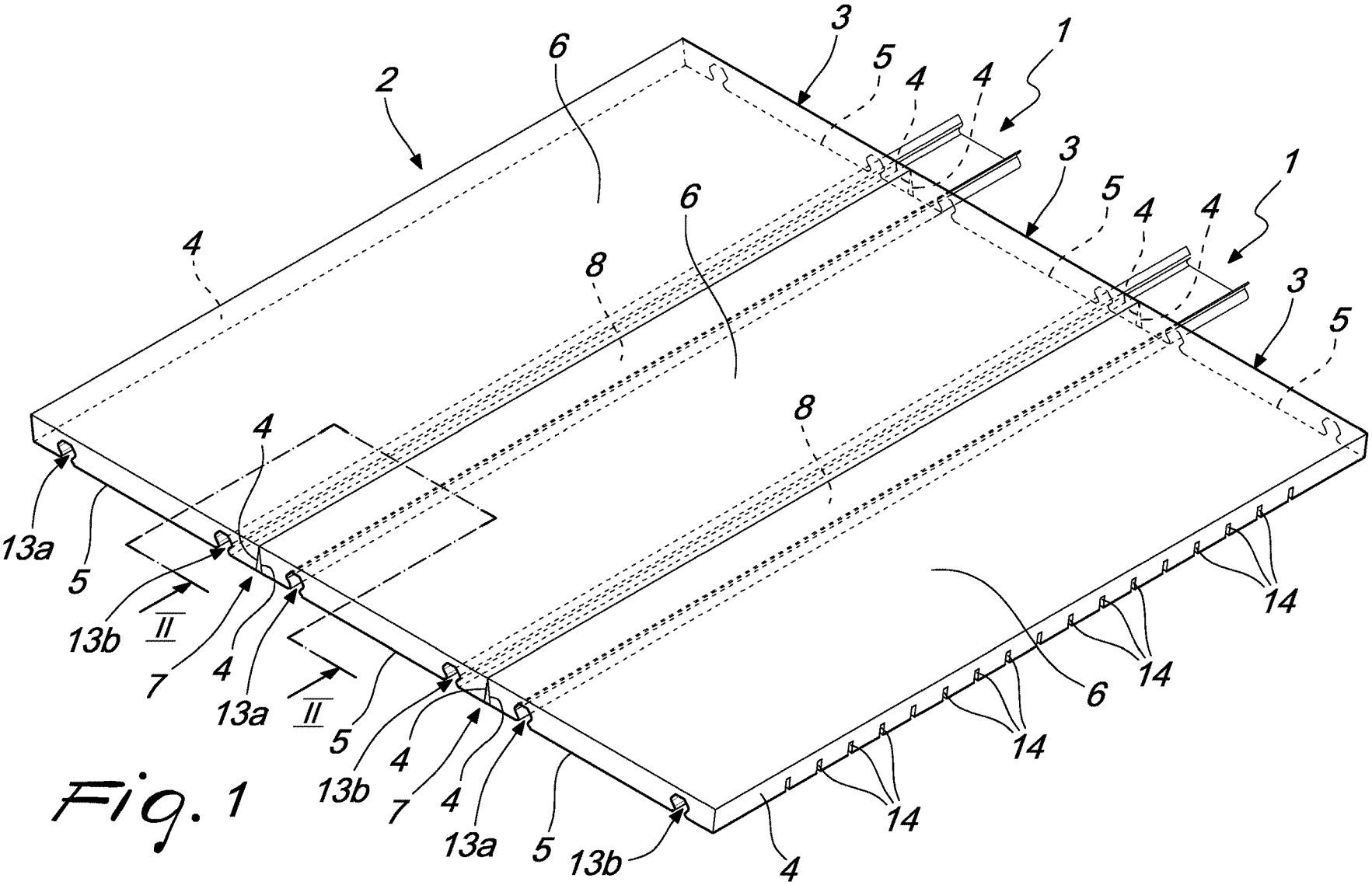
FIG. 1 is a perspective view from above of the joint according to the disclosure applied to strips.
Figure 2A:
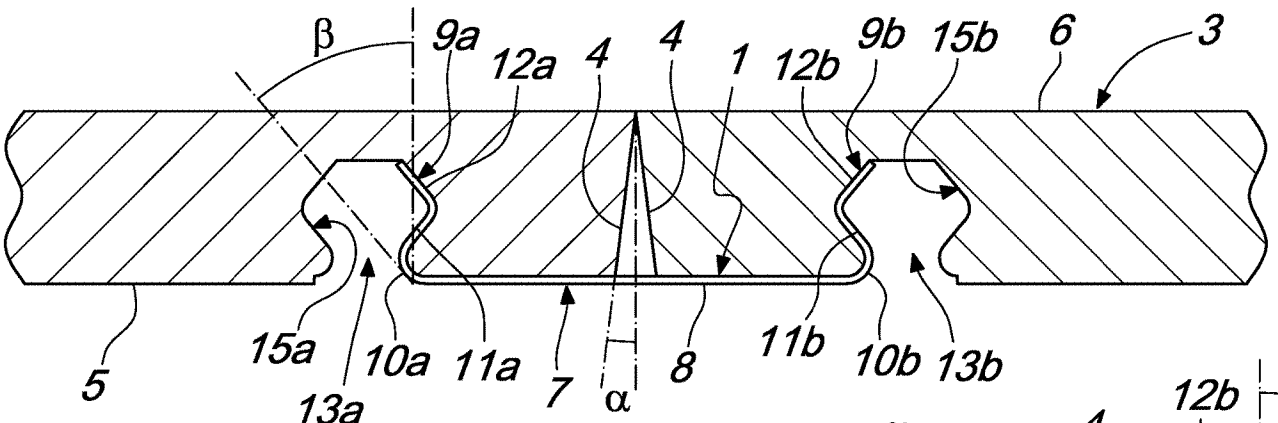
FIGS. 2*a* and 2*b* are partially cross-sectional views of the joint applied to strips, taken along the line II-II in FIG. 1.
Figure 2B:
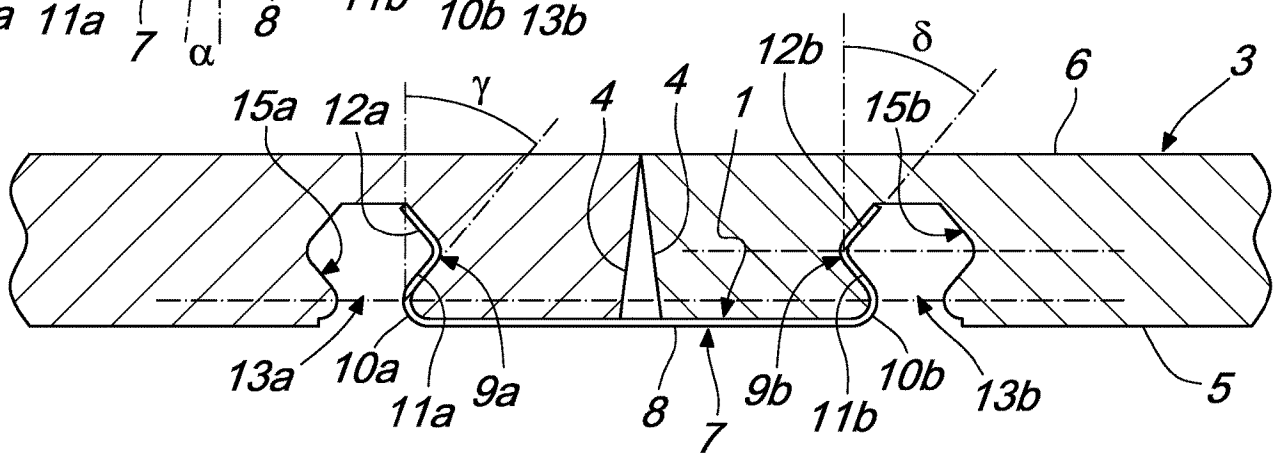
Figure 3:
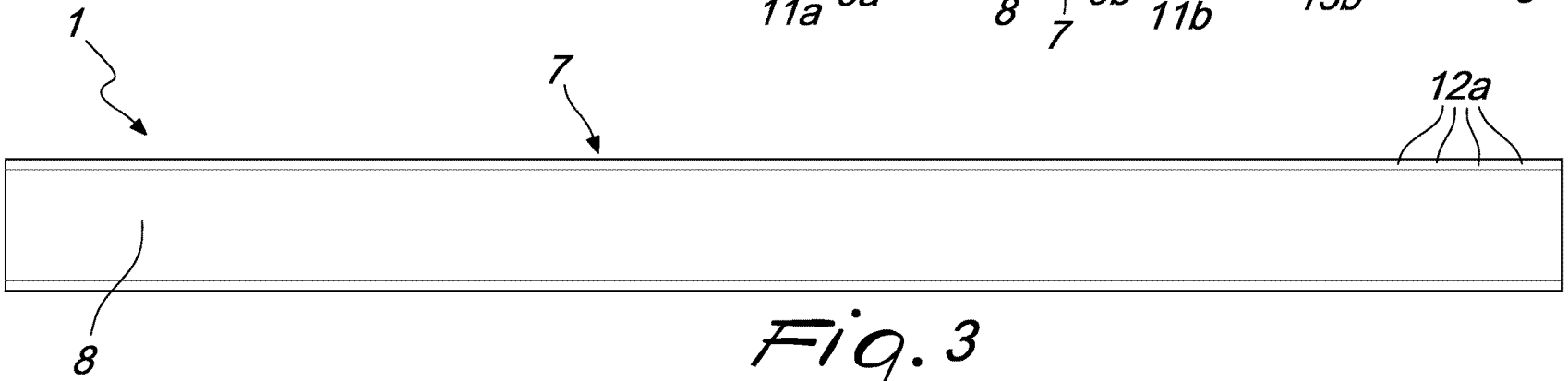
FIG. 3 is a view from above of the joint.
Figures 4, 5:
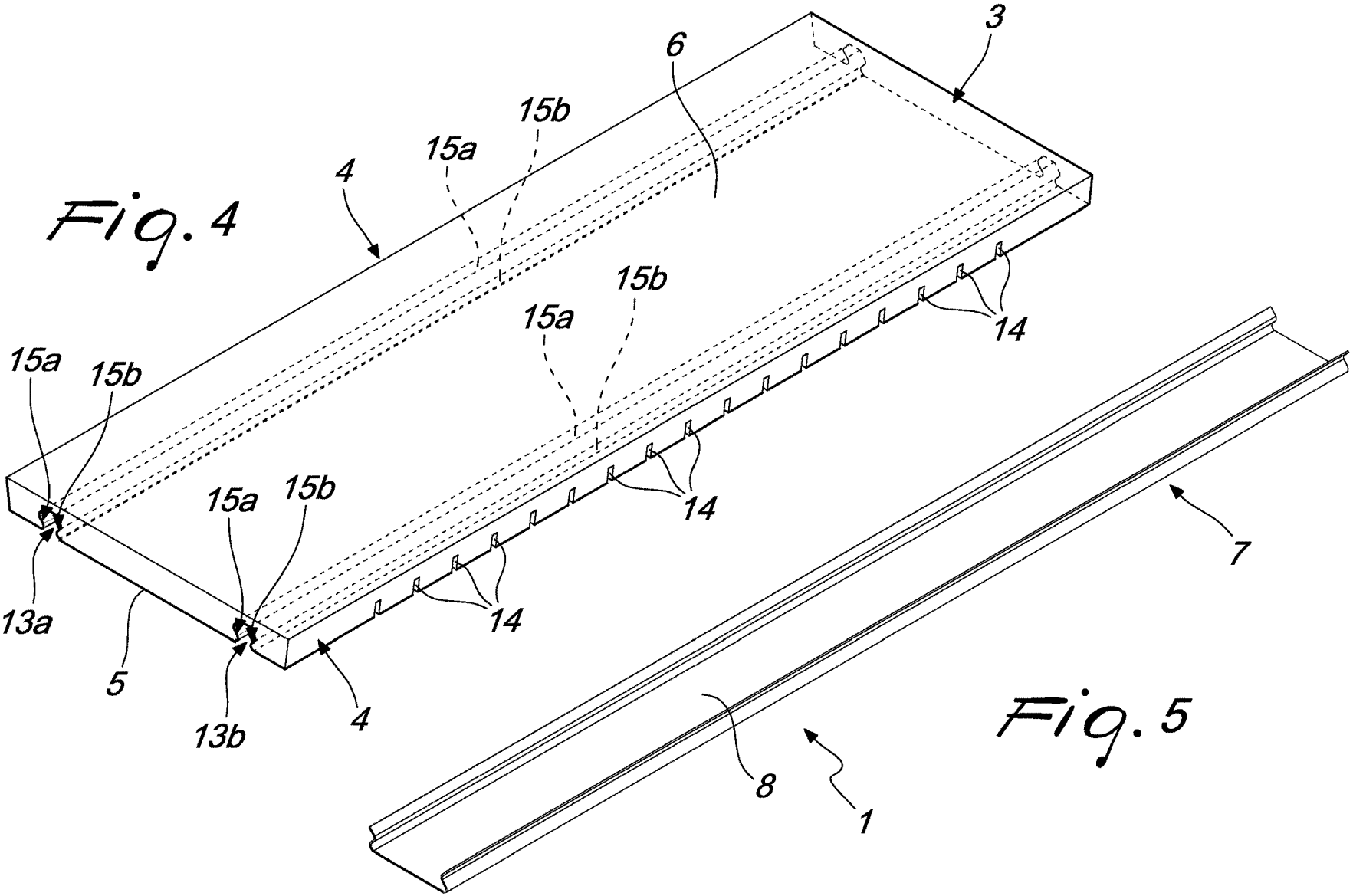
FIG. 4 is a perspective view from above of a strip.
FIG. 5 is a perspective view from above of the joint.
Figure 6:
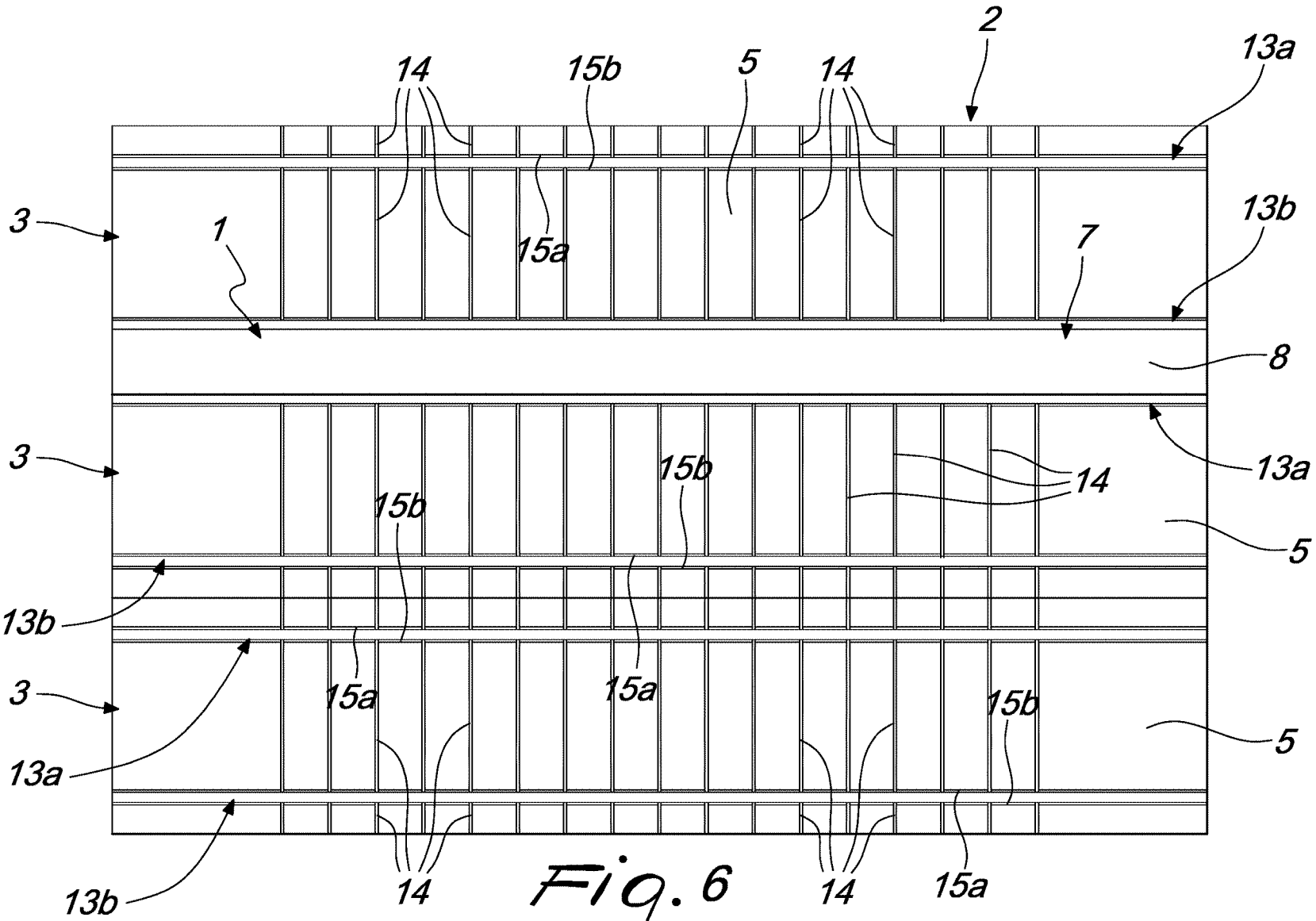
FIG. 6 is a view from below of the joint applied to strips.

In the exemplary embodiments that follow, individual characteristics, given in relation to specific examples, may actually be interchanged with other different characteristics that exist in other exemplary embodiments.

With reference to the figures, the reference numeral 1 generally designates a joint for floors 2 that are constituted by a series of strips 3, of solid or engineered wood, substantially parallelepiped in shape with a polygonal end face, preferably rectangular, which can be arranged mutually adjacent.

In the embodiment shown in FIG. 1 to FIG. 6, the strips 3 have substantially longitudinal perimetric edges 4 which are planar and slightly inclined by an angle α (alpha) with respect to the vertical and are such as to define a width of the lower surface 5 that is less than the corresponding width of the upper surface 6.

Figure 7:
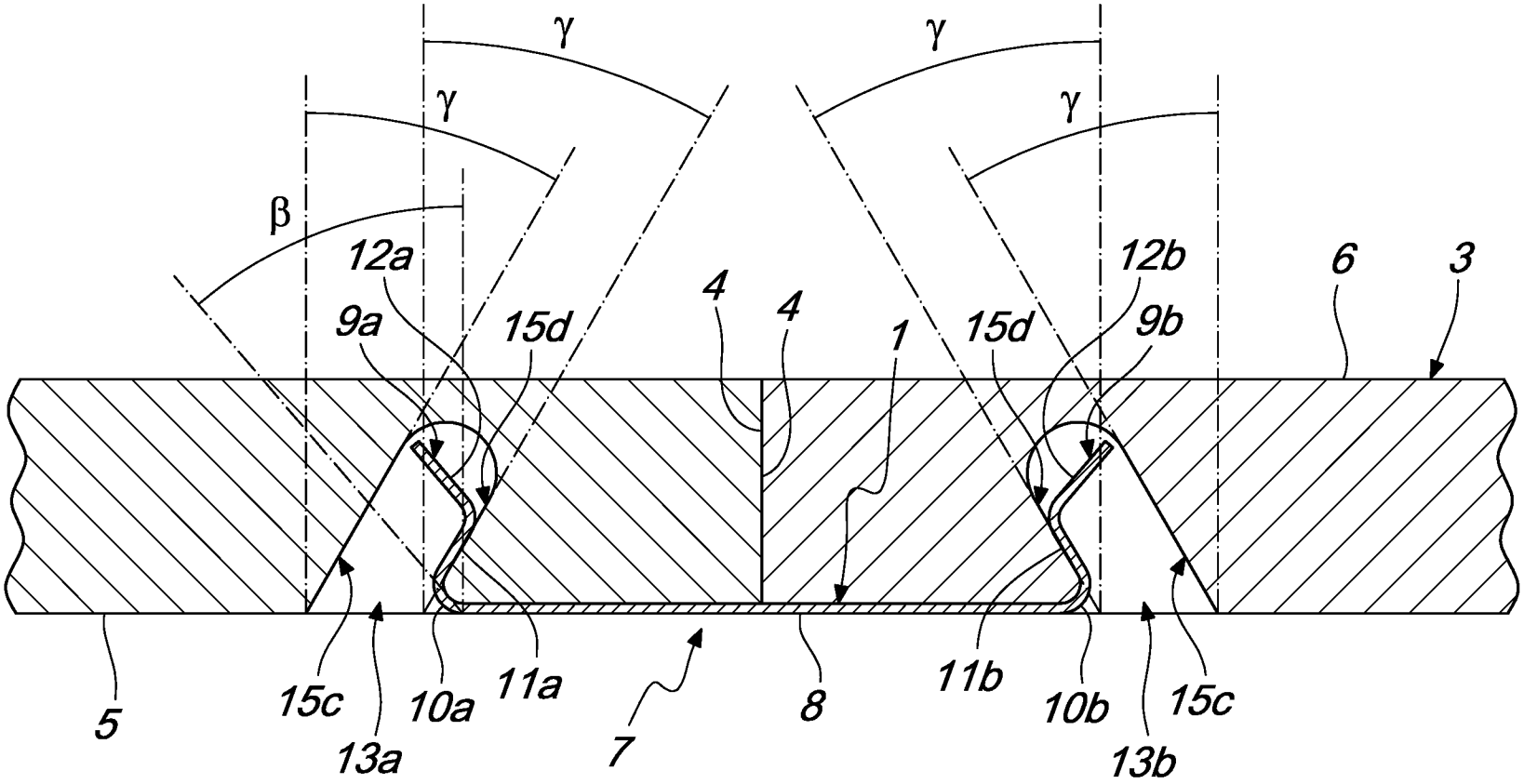
FIG. 7 is a view similar to that in FIGS. 2*a* and 2*b* of the joint applied to a variation of embodiment of the strips.

In the embodiment shown in FIG. 7, the strips 3 have longitudinal perimetric edges 4 which are planar and vertical, so as to define a width of the lower surface 5 which is equal to the corresponding width of the upper surface 6.

The joint 1 is constituted by a single linear bar 7, made of plastic material, which has a substantially C-shaped cross-section and is of a desired length.

The bar 7 has a length that extends by an extent such that a single bar can be used to connect two adjacent strips 3 to each other, using the majority of their length.

Preferably the length of the bar 7 is substantially equal at least to the length of the strip 3.

The bar 7 is thus constituted by a central planar body 8, which is substantially rectangular and from the longitudinal perimetric edges of which protrude, in the same direction and seamlessly along all of the planar body 8, a first tab and a second tab 9*a*, 9*b*, which are elastically deformable and are arranged along a same axis which is substantially perpendicular to the central planar body 8.

Each one of the first tab and the second tab 9*a*, 9*b* is substantially S-shaped with the free end directed toward the outside of the planar body 8.

The shape of each pair of tabs 9*a*, 9*b* can be the most appropriate as a function of specific requirements, such as the type or the size or the material that constitutes the strip 3 being used.

In the particular embodiments illustrated in FIG. 1 to FIG. 7, each one of the first tab and the second tab 9*a*, 9*b* has a first portion 10*a*, 10*b* that is substantially arc-shaped and that is meant for blending with the planar body 8, which protrudes toward the outside of the planar body 8 according to an initial constant inclination which has an angle β (beta) of substantially approximately (55)°±10°, preferably approximately 65° C., considering a rotation starting from a plane that is perpendicular to the planar body 8 toward the outside of the planar body 8.

Each one of the first tab and the second tab 9*a*, 9*b* has a second portion 11*a*, 11*b*, contiguous and blended with the respective first portion 10*a*, 10*b*, which protrudes and is directed toward the inside of the planar body 8 according to a constant inclination which has an angle γ (gamma) preferably of approximately (45)°±10°, considering a rotation starting from a plane that is perpendicular to the planar body 8 toward the inside of the planar body 8.

Each one of the first tab and the second tab 9*a*, 9*b* furthermore has a third portion 12*a*, 12*b*, contiguous and blended with the second portion 11*a*, 11*b*, which protrudes toward the outside of the planar body 8 according to a constant inclination which has an angle δ (delta) preferably of approximately (55)°±10° with respect to a plane that is perpendicular to the planar body 8 and is oriented toward the outside of the planar body 8.

Each strip 3 has, at the lower surface 5 and proximate to each one of its longitudinal perimetric edges 4, at least one seat 13*a*, 13*b*.

The length of the seats 13*a*, 13*b* is equal to the length of the strip 3.

In all the embodiments illustrated, the seats 13*a*, 13*b* are identical to each other and have a shape that is substantially complementary at least to the shape of the first portions 10*a*, 10*b* and at least to the shape of the initial part of the second portions 11*a*, 11*b*.

In the specific embodiment shown in FIG. 1 to FIG. 6, the seats 13*a*, 13*b* are mutually identical and have a shape that is substantially complementary to the shape of the first portion, the second portion and the third portion 10*a*, 10*b*, 11*a*, 11*b*, 12*a*, 12*b* so as to allow the insertion and the temporary accommodation of the first tab and the second tab 9*a*, 9*b* adjacent to the resting surfaces of the first portion, the second portion and the third portion 10*a*, 10*b*, 11*a*, 11*b*, 12*a*, 12*b*.

Each seat 13*a*, 13*b* therefore has two side walls 15*a*, 15*b* which follow substantially in sequence the angle β (beta), the angle γ (gamma) and the angle δ (delta), with the result that the seats 13*a*, 13*b* are shaped complementarily to the first tab and the second tab 9*a*, 9*b*.

Such side walls 15*a*, 15*b* of each seat 13*a*, 13*b* are mutually spaced apart by a space that is sufficient to allow the elastic deformation of the first tab and the second tab 9*a*, 9*b* during their insertion/removal.

In the specific embodiment shown in FIG. 7, each seat 13*a*, 13*b* has two side walls 15*c*, 15*d*, each one slightly inclined by a same angle which is substantially parallel to the angle γ (gamma) of the second portions 11*a*, 11*b* of the first tab and the second tab 9*a*, 9*b*, 'the side walls 15*c*, 15*d* being substantially mutually parallel and blended by a preferably curved upper wall.

The seats 13*a*, 13*b* are arranged, with respect to the vertical planar longitudinal perimetric edges 4, so that they are mutually opposite.

The side wall 15*d* has a first initial part which is shaped complementarily to the first portion and to the second portion 10*a*, 10*b*, 11*a*, 11*b* of the first tab and second tab 9*a*, 9*b* and has an initial constant inclination which has an angle β (beta).

The walls 15*c*, 15*d* are mutually spaced apart by a space that is sufficient to allow the elastic deformation of the first tab and second tab 9*a*, 9*b* during their insertion/removal; such space is substantially slightly greater than the length of the third portions 12*a*, 12*b*.

In all the embodiments illustrated, the width of the joint 1 is substantially equal to double the distance between a longitudinal perimetric edge 4 of the strip 3 and the adjacent seat 13*a*, 13*b*: basically, the overall width of the joint 1 is such that its arrangement below the strip 3 causes the first tab and second tab 9*a*, 9*b* to be arranged at the seats 13*a*, 13*b* of two strips 3 once they have been arranged beside each other.

Furthermore, the thickness of the planar body 8 of the joint 1 may or may not be accommodated in an adapted cavity provided on the lower surface 5 of each strip 3 in the region that runs from the seats 13*a*, 13*b* to the longitudinal perimetric edges 4.

The shapes of the seats 13*a*, 13*b* and of the first tab and second tab 9*a*, 9*b* are such that the latter can be inserted into the seats 13*a*, 13*b* by virtue of an elastic deformation that can be imparted outward to the third portions 12*a*, 12*b* during their insertion into the seats 13*a*, 13*b*.

The shape of the first tab and second tab 9*a*, 9*b* is such that, once they have been inserted into the seats 13*a*, 13*b*, their return to the initial shape results in a removable clamp-like mechanical locking with respect to the seats 13*a*, 13*b*.

At the lower surface 5 of each strip 3 there is a plurality of grooves 14, which are transverse and are mutually parallel, and which extend for the entire width of the strip 3 and are adapted to increase the flexibility of the strips 3.

In use therefore, a series of joints 1, conveniently mutually spaced apart, are initially placed on the foundation of the floor 2: each one of these is then associated with the various strips 3, arranging the first tab 9*a* in the seat 13*b* of one strip 3 and the second tab 9*b* in the seat 13*a* of a separate and adjacent strip 3.

It is in fact sufficient to apply a light pressure on each strip 3 in order to obtain the coupling with a joint 1; the decoupling is equally simple and rapid.

The elastic deformation of the first tab and the second tab 9*a*, 9*b* that can be imparted during coupling, once the tabs are accommodated in the seats 13*a*, 13*b*, forces the clamp-like connection of two adjacent strips 3 which are thus stably arranged beside each other; the possible presence of the slightly inclined form of the longitudinal perimetric edges 4 makes it possible to compensate for any tolerances of the strips.

In practice it has been found that the disclosure has fully achieved the intended aim and advantages, a joint having been obtained that makes it possible both to provide strip floors that can be laid rapidly and without the use of adhesives, and also to offer low costs of production, storage and transport by virtue of the production and disposal of the joint from plastic material and by virtue of the fact that there are only a first tab and a second tab which protrude laterally, in the same direction and seamlessly along the planar body.

Furthermore, the use of plastic material and the arrangement of the first tab and the second tab seamlessly along the planar body make it possible to achieve an optimal coupling with the seats present in the strips even if the tabs should be accidentally and temporarily bent, and makes it possible to use the joint even if the intended thickness of the floor is small.

The structural memory of the plastic material furthermore makes it possible to reuse the joint 1 multiple times in the event of removal from the floor.

Furthermore the disclosure makes it possible to obtain floating and raised floors which can be walked on immediately after laying, it being unnecessary to wait for the time required for the drying of the adhesive which, being absent, ensures a healthful environment, free from substances that are harmful to the user.

It has furthermore been found that the joint 1 is capable on its own of ensuring the stable fixing of two strips 3, once installed, given that the interaction between at least the first portions 10*a*, 10*b* and the initial part of the second portions 11*a*, 11*b* with much of the side surface of the seats 13*a*, 13*b* creates a force that pushes the strips 3 downward, keeping all the strips 3 that go to make up the floor 2 joined together, and keeping them resting firmly on the ground.

Finally, each individual strip can be removed or replaced, together or individually, rapidly and easily, without needing to dismantle the entire floor, thus reducing, by virtue of the use of plastic material, the noise that is characteristic of a floating or raised floor.

Furthermore, the foundation on which the floor rests can be made of any material, which also renders the disclosure applicable in buildings undergoing renovation.

The plurality of grooves 14 which extend along the entire width of the lower surface 5 of the strip 3 increase the flexibility of those strips 3.

The joint is structurally simple and of low cost.

Naturally the materials used as well as the dimensions of the individual components of the device according to the disclosure may be more relevant according to specific requirements.

The various means of achieving certain different functions certainly need not coexist only in the embodiment shown, but may be present in many embodiments, even if they are not shown.

The characteristics indicated above as advantageous, convenient or the like, may also be missing or be substituted by equivalent characteristics.

The disclosures in Italian Patent Application No. 102019000003627 from which this application claims priority are incorporated herein by reference.

The invention claimed is:

1. A joint for floors that are constituted by a series of strips, which is constituted by a single linear bar which is constituted by a central planar body from which a single first tab and a single second tab, which are elastically deformable and selectively associable at seats provided in a lower region and longitudinally with respect to said strips and adjacent to longitudinal perimetric edges thereof, protrude laterally, said single first tab and said single second tab being substantially S-shaped with a free end directed toward an outside of said planar body, wherein said linear bar is made of plastic material, and wherein said single first tab and said single second tab protrude laterally from said planar body with a continuous rectilinear profile along said planar body and have a first portion, substantially arc-shaped and configured for blending with said planar body, which protrudes toward the outside of said planar body, a second portion, contiguous and blended with the respective said first portion, which protrudes and is directed toward an inside of said planar body, and a third portion, contiguous and blended with said second portion, which protrudes toward the outside of said planar body, said seats having a shape that is substantially complementary at least to a shape of said first portions and at least to a shape of an initial part of said second portions.

2. The joint according to claim 1, wherein said seats are transverse with respect to said strips and are mutually parallel, and extend for an entire width of said strip and are adapted to increase flexibility of said strips.

3. The joint according to claim 1, wherein said strips are configured to be arranged mutually adjacent and have a substantially parallelepiped shape with a polygonal end face which has substantially said longitudinal perimetric edges which are planar and inclined by an angle α (alpha) with respect to a vertical and are such as to define a width of a lower surface of said strips that is less than a corresponding width of an upper surface of said strips.

4. The joint according to claim 1, wherein said strips are configured to be arranged mutually adjacent and have a substantially parallelepiped shape with a polygonal end face in which longitudinal perimetric edges are planar and vertical, said strips having a width of a lower surface which is equal to a corresponding width of an upper surface.

5. The joint according to claim 1, wherein said linear bar has a substantially C-shaped cross-section and a length that is substantially comparable to that of said strip, said bar being constituted by said central planar body, which is substantially rectangular, said first tab and said second tab being elastically deformable and being arranged along a same axis that is substantially perpendicular to said central planar body, each one of said single first tab and said single second tab being substantially S-shaped with a free end directed toward an outside of said planar body.

6. The joint according to claim 4, wherein said first portion protrudes toward the outside of said planar body according to an initial constant inclination which has an angle β (beta) of substantially (55)°±10°.

7. The joint according to claim 6, wherein said second portion protrudes and is directed toward the inside of said planar body according to a constant inclination which has an angle γ (gamma) of substantially (45)°±10°.

8. The joint according to claim 7, wherein said third portion protrudes toward the outside of said planar body according to a constant inclination which has an angle δ (delta) of substantially (55)°±10°, with respect to a plane that is perpendicular to said planar body and is oriented toward the outside of said planar body.

9. The joint according to claim 8, wherein each strip has, at said lower surface and proximate to each one of said longitudinal perimetric edges, said seats, mutually identical, the shape of which is substantially complementary to the shape of said first portion, said second portion and said third portion so as to allow insertion and accommodation of said single first tab and said single second tab adjacent to resting surfaces of said first portion, said second portion and said third portion, each one of said seats having a side wall which follows substantially in sequence the angle of said angle β (beta), said angle γ (gamma) and said angle δ (delta), said seats being shaped complementarily to said single first tab and said single second tab, said side walls being mutually spaced apart by a space that is sufficient to allow elastic deformation of said first tab and said second tab during their insertion/removal.

10. The joint according to claim 7, wherein each strip has, at said lower surface and proximate to each one of said longitudinal perimetric edges, said seats each have two side walls, each wall slightly inclined by a same angle which is substantially parallel to said angle γ (gamma) of said second portions of said single first tab and said single second tab, said side walls being substantially mutually parallel and blended by a curved upper wall, said seats being arranged, with respect to said planar longitudinal perimetric edges, so that they are mutually opposite, said side walls having a first initial part which is shaped complementarily to said first portion and said second portion of said single first tab and said single second tab and having an initial constant inclination which has an angle β (beta), said side walls being mutually spaced apart by a space that is sufficient to allow the elastic deformation of said single first tab and said single second tab during their insertion/removal, said space being substantially slightly greater than the length of said third portions.

11. The joint according to claim 1, wherein the shapes of said seats and of said single first tab and said single second tab are such that said single first and single second tabs can be inserted into said seats by virtue of an elastic deformation that can be imparted outward to said third portions during their interaction with side walls, the shape of said single first tab and said single second tab being such that, once they have been inserted into said seats, a return of said single first and second tabs to an initial shape results in a removable clamp mechanical locking with respect to said seats.

12. The joint according to claim 1, having a width that is substantially equal to twice a distance between one of said longitudinal perimetric edges of said strip and an adjacent seat, a total width of said joint being such that an arrangement of said joint below said strip causes said single first tab and said single second tab to arrange themselves at side walls of said seats of two of said strips once they have been arranged beside each other.

* * * * *